US011065875B2

(12) United States Patent
Sugiura et al.

(10) Patent No.: US 11,065,875 B2
(45) Date of Patent: Jul. 20, 2021

(54) LIQUID DISCHARGE APPARATUS AND IMAGE RECORDING APPARATUS INCLUDING THE SAME

(71) Applicant: Brother Kogyo Kabushiki Kaisha, Nagoya (JP)

(72) Inventors: Keita Sugiura, Toyokawa (JP); Shohei Koide, Nagoya (JP); Keita Hirai, Nagoya (JP); Hiroshi Katayama, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/819,588

(22) Filed: Mar. 16, 2020

(65) Prior Publication Data

US 2020/0307205 A1 Oct. 1, 2020

(30) Foreign Application Priority Data

Apr. 1, 2019 (JP) ..... JP2019-069751

(51) Int. Cl.
*B41J 2/14* (2006.01)
*B41J 2/175* (2006.01)

(52) U.S. Cl.
CPC ..... *B41J 2/14201* (2013.01); *B41J 2/17596* (2013.01); *B41J 2002/14419* (2013.01)

(58) Field of Classification Search
CPC ..... B41J 2/17596; B41J 2002/14419; B41J 2/14201; B41J 2/14233
USPC ..... 347/20, 54, 68, 70–72
See application file for complete search history.

(56) References Cited

U.S. PATENT DOCUMENTS

| | | | | |
|---|---|---|---|---|
| 8,157,352 | B2 * | 4/2012 | Von Essen | B41J 2/14233 347/42 |
| 10,189,256 | B2 * | 1/2019 | Kobayashi | B41J 2/17596 |
| 10,696,046 | B2 * | 6/2020 | Kawahara | B41J 2/17596 |
| 10,766,257 | B2 * | 9/2020 | Kato | B41J 2/155 |
| 2010/0214359 | A1 | 8/2010 | Von Essen et al. | |
| 2013/0228084 | A1 | 9/2013 | Brady et al. | |
| 2013/0229473 | A1 | 9/2013 | Wells, Jr. et al. | |

FOREIGN PATENT DOCUMENTS

| | | | |
|---|---|---|---|
| JP | 2010-241121 | A | 10/2010 |
| JP | 2015-509454 | A | 3/2015 |

* cited by examiner

*Primary Examiner* — An H Do
(74) *Attorney, Agent, or Firm* — Banner & Witcoff, Ltd.

(57) ABSTRACT

There is provided a liquid discharge apparatus configured to discharge a liquid, including a channel member for the liquid. The channel member is formed to include: a pressure chamber configured to contain the liquid; a nozzle configured to discharge the liquid; a connection channel connecting the pressure chamber and the nozzle; and a discharge channel which is connected to the connection channel so as to discharge the liquid in the connection channel or connected to the pressure chamber so as to discharge the liquid in the pressure chamber. An intersection line between an orthogonal plane orthogonal to an extending direction of the discharge channel and an upper surface of the discharge channel defining an upper portion of the discharge channel has an arc-like shape protruding upwardly.

18 Claims, 6 Drawing Sheets

LIQUID DISCHARGE APPARATUS AND IMAGE RECORDING APPARATUS INCLUDING THE SAME

CROSS REFERENCE TO RELATED APPLICATION

The present application claims priority from Japanese Patent Application No. 2019-069751 filed on Apr. 1, 2019, the disclosure of which is incorporated herein by reference in its entirety.

BACKGROUND

Field of the Invention

The present disclosure relates to a liquid discharge apparatus and an image recording apparatus including the liquid discharge apparatus.

Description of the Related Art

There is used an image recording apparatus that discharges a liquid, such as an ink, on a medium, such as a sheet, via a liquid discharge apparatus to record an image on the medium. The liquid discharge apparatus typically includes a pressure chamber accommodating the liquid and a nozzle connected fluidally to the pressure chamber. The liquid is discharged from the nozzle by increasing inner pressure in the pressure chamber by use of an actuator or the like.

In such a liquid discharge apparatus and such an image recording apparatus, there is known a problem in which characteristics of the liquid deteriorate in the liquid discharge apparatus, resulting in the decrease in quality of an image to be recorded. The change in characteristics of the liquid may be caused in the liquid staying in the liquid discharge apparatus when the image recording apparatus is not in use.

In order to solve the above problem, Published Japanese Translation, of PCT International Publication for Patent Application, No. 2015-509454 discloses a print head assembly that includes a recirculation channel and in which ink is continuously recirculated when the print head assembly is in operation or on standby.

SUMMARY

As a cause of the deterioration in quality of an image to be recorded by the liquid discharge apparatus and the image recording apparatus, there is known the mixing of air bubbles into the liquid, in addition to the change in characteristics of the liquid. The liquid discharge apparatus is thus desired to satisfactorily discharge the air bubbles mixed into the liquid in the liquid discharge apparatus. However, it can not be said that the recirculation channel of the print head assembly described in Published Japanese Translation, of PCT International Publication for Patent Application, No. 2015-509454 is capable of satisfactorily discharging the air bubbles mixed into the ink in the print head assembly.

An object of the present disclosure is to provide a liquid discharge apparatus capable of satisfactorily discharging air bubbles mixed into a liquid in the liquid discharge apparatus and an image recording apparatus including the liquid discharge apparatus.

According to a first aspect of the present disclosure, there is provided a liquid discharge apparatus configured to discharge a liquid, including a channel member for the liquid, wherein the channel member is formed to include:

a pressure chamber configured to contain the liquid;

a nozzle configured to discharge the liquid;

a connection channel connecting the pressure chamber and the nozzle; and a discharge channel which is connected to the connection channel so as to discharge the liquid in the connection channel or connected to the pressure chamber so as to discharge the liquid in the pressure chamber, and an intersection line between an orthogonal plane orthogonal to an extending direction of the discharge channel and an upper surface of the discharge channel defining an upper portion of the discharge channel has an arc-like shape protruding upwardly.

According to a second aspect of the present disclosure, there is provided an image recording apparatus, including:

the liquid discharge apparatus according to the first aspect, a liquid supply channel through which the liquid is supplied to the liquid discharge apparatus, a liquid recovery channel through which the liquid is recovered from the liquid discharge apparatus, and a pump configured to apply pressure so that the liquid flows through the liquid supply channel, the pressure chamber, the connection channel, the discharge channel, and the liquid recovery channel in that order.

BRIEF DESCRIPTION OF THE DRAWINGS

FIGS. 5A to 5F each illustrate the discharge of an air bubble via the second throttle channel, wherein FIG. 5A depicts a state in which the air bubble is positioned in a descender channel, FIG. 5B depicts a state in which part of the air bubble is pushed into the second throttle channel, FIG. 5C is a cross-sectional view taken along a line C-C in FIG. 5B, FIG. 5D depicts a state in which the entirety of the air bubble is positioned in the second throttle channel, FIG. 5E is a cross-sectional view taken along a line E-E in FIG. 5D, and FIG. 5F depicts a state in which the air bubble is positioned in a channel according to a comparative example.

DESCRIPTION OF THE EMBODIMENTS

Explanation is made, as an example, about a case in which an image is recorded on a sheet P by an ink-jet head (liquid discharge apparatus) 100 and a printer (image forming apparatus) 1000 including the ink-jet head 100 according to an embodiment of the present disclosure.

<Printer 1000>

Figure 1:
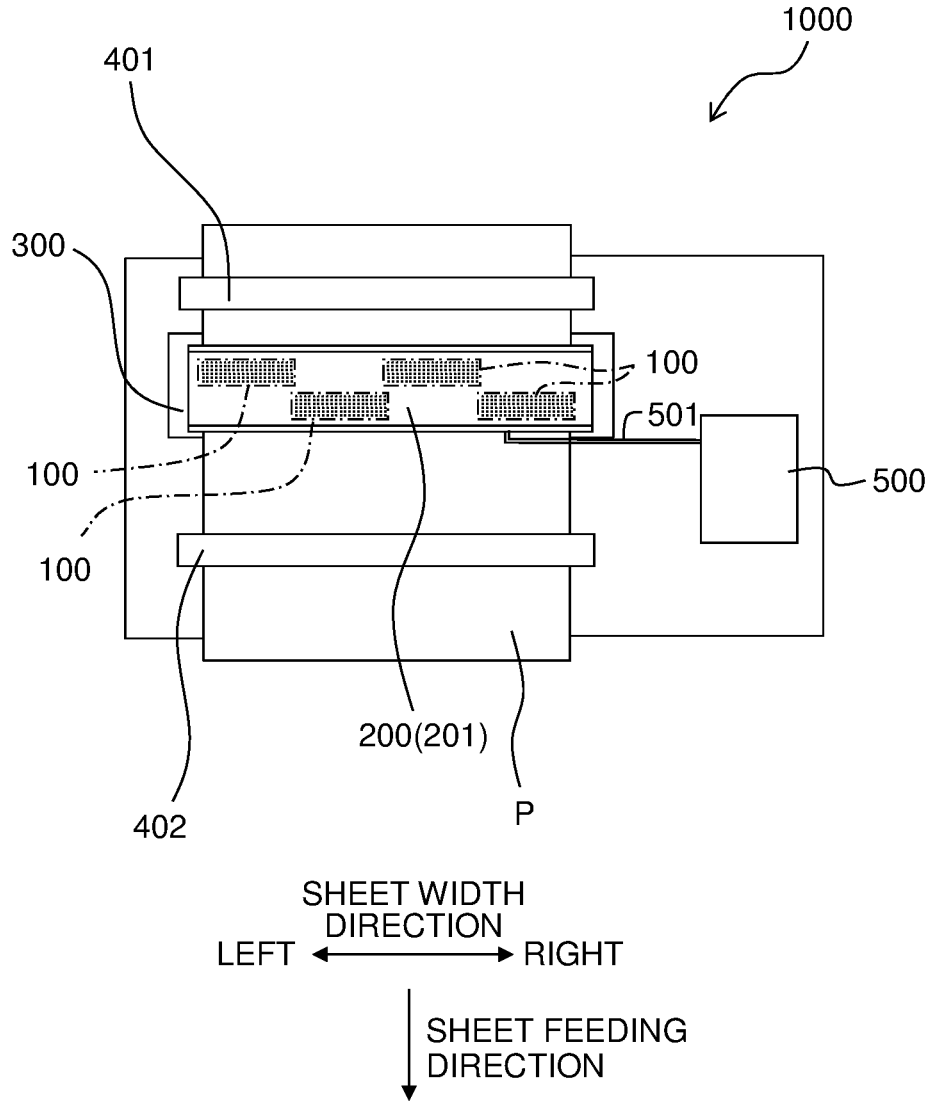
FIG. 1 schematically depicts a configuration of a printer according to an embodiment of the present disclosure.

As depicted in FIG. 1, the printer 1000 of this embodiment mainly includes a line head 200 including four ink-jet heads 100, a platen 300 disposed below the line head 200, a pair of conveyance rollers 401, 402 arranged with the platen 300 interposed therebetween, and an ink-tank 500.

Figure 2:
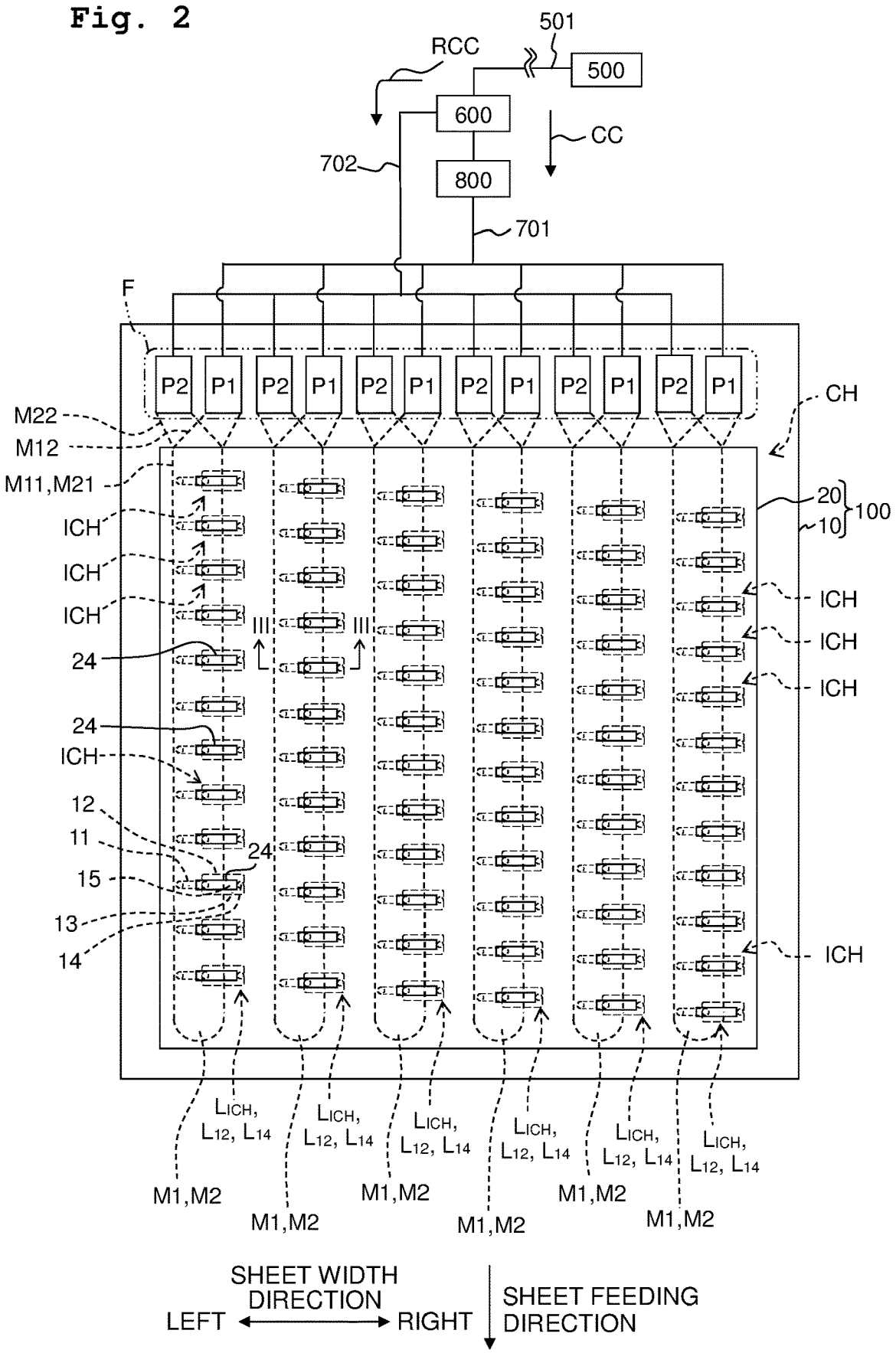
FIG. 2 is a schematic plan view of an ink-jet head according to the embodiment of the present disclosure.

As depicted in FIG. 2, the printer 1000 further includes a subtank 600 containing ink supplied from the ink tank 500, an ink supply channel (liquid supply channel) 701 through which the ink in the subtank 600 is supplied to the ink-jet head 100, an ink recovery channel (liquid recovery channel) 702 through which the ink in the ink-jet head 100 is supplied to the subtank 600, and a pump 800 provided in the ink supply channel 701. Since FIGS. 1 and 2 are schematic views, a shape in plan view of the ink-jet head 100 depicted in FIG. 1 is different from that of the ink-jet head 100 depicted in FIG. 2. However, the ink-jet head 100 depicted in FIG. 1 is the same as the ink-jet head 100 depicted in FIG. 2.

In the following, a direction in which the pair of conveyance rollers 401, 402 are arranged (i.e., a direction in which the sheet P is conveyed at the time of image formation) is referred to as a "sheet feeding direction" of the printer 1000 and the ink-jet head 100. An upstream side in the sheet feeding direction is referred to as a "sheet supply side", and a downstream side in the sheet feeding direction is referred to as a "sheet discharge side". Further, a direction in a horizontal plane orthogonal to the sheet feeding direction (i.e., a direction in which rotation shafts of the conveyance rollers 401, 402 extend) is referred to as a "sheet width direction". A direction orthogonal to the "sheet feeding direction" and the "sheet width direction" is referred to as an "up-down direction". In the explanation about channels in the present specification, an "upstream side" and a "downstream side" means an upstream side and a downstream side in a direction in which the liquid in the concerned channel flows.

The line head 200 includes a holding member 201 and the four ink-jet heads 100 held by the holding member 201. The holding member 201 is long in the sheet width direction, is short in the sheet feeding direction, and has a rectangle shape in plan view. The holding member 201 is supported by support portions (not depicted) at both ends in the sheet width direction.

In the holding member 201, the four ink-jet heads 100 are arranged zigzag in the sheet width direction. The ink-jet heads 100 are held by the holding member 201 with nozzles 14 (described below) facing downward.

The platen 300 is a plate-like member that supports the sheet P from an opposite side (lower side) of the ink-jet heads 100 when ink is discharged from the ink-jet head(s) 100 to the sheet P. A width in the sheet width direction of the platen 300 is larger than a width of the largest sheet for which image recording can be performed by the printer 1000.

The pair of conveyance rollers 401, 402 are arranged with the platen 300 interposed therebetween in the sheet feeding direction. When an image is formed on the sheet P by the ink-jet head(s) 100, the pair of conveyance rollers 401, 402 feeds the sheet P in a predefined manner toward the sheet discharge side in the sheet feeding direction.

The ink tank 500 is a container that contains ink to be discharged from the ink-jet head 100.

In the holding member 201 of the line head 200, four subtanks 600, four ink supply channels 701, four ink recovery channels 702, and four pumps 800 are respectively provided for the four ink-jet heads 100.

As depicted in FIG. 2, the subtank 600 is connected to the ink tank 500 via an ink channel member 501. First ends of the ink supply channel 701 and the ink recovery channel 702 are connected to the subtank 600, and second ends of the ink supply channel 701 and the ink recovery channel 702 are connected to the ink-jet head 100. The pump 800 circulates ink along a circulation channel formed by the ink supply channel 701, the ink-jet head 100, the ink recovery channel 702, and the subtank 600. Although the pump 800 is provided in the ink supply channel 701 in FIG. 2, it is merely a nonlimitative example.

<Ink-Jet Head 100>

Subsequently, the ink-jet head 100 is explained.

Figure 3:
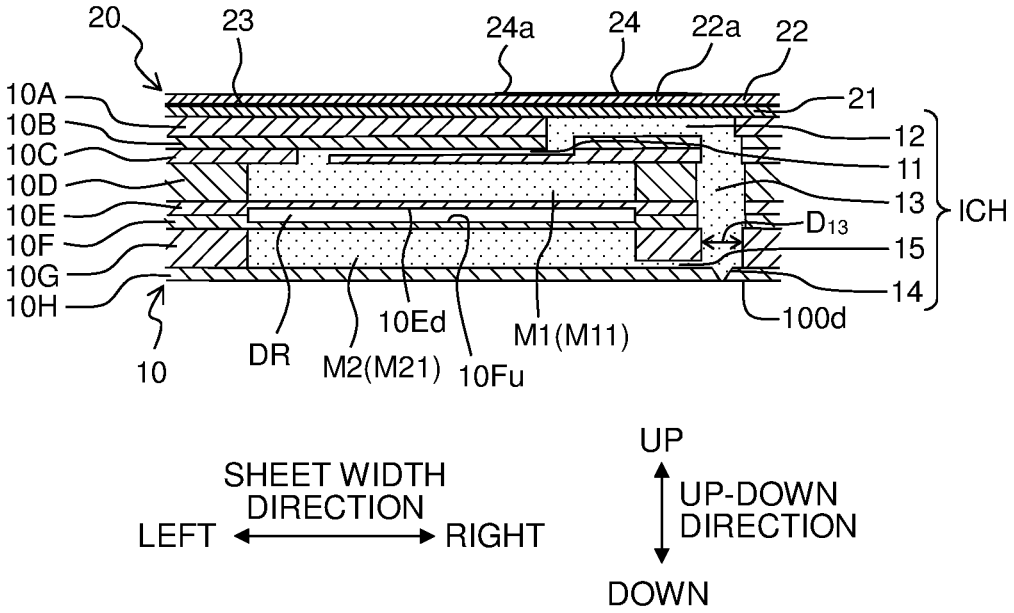
FIG. 3 is a cross-sectional view taken along a line III-III in FIG. 2.

The ink-jet head 100 includes a channel unit (channel member) 10 and a piezoelectric actuator 20 provided on the channel unit 10 (FIGS. 2 and 3).

<Channel Unit 10>

The channel unit 10 is formed having a channel CH for distributing ink from the subtank 600 to appropriate positions so as to discharge ink from the nozzles 14. The channel unit 10 has a stacked structure in which eight plates 10A to 10H are stacked on top of each other in that order from the top. The channel CH is formed by removing part of each of the plates 10A to 10H.

As depicted in FIGS. 2 and 3, the channel CH mainly includes individual channels ICH arranged in the sheet feeding direction and the sheet width direction, supply manifold channels M1 through which the inks supplied from the ink supply channels 701 are distributed to the individual channels ICH, and return manifold channels M2 in which the inks from the individual channels ICH are merged together and through which the inks enter the ink recovery channels 702. The channel CH also includes inflow openings P1 connecting the ink supply channels 701 and the supply manifold channels M1 and outflow openings P2 connecting the ink recovery channels 702 and the return manifold channels M2.

The individual channels ICH are arranged in the sheet feeding direction to form individual channel rows $L_{ICH}$. One supply manifold channel M1 and one return manifold channel M2 are provided for each individual channel row $L_{ICH}$. The return manifold channels M2 are arranged below the supply manifold channels M1. In this embodiment, six individual channel rows $L_{ICH}$, each of which is formed by twelve individual channels ICH, are arranged in the sheet width direction. The number of the supply manifold channels M1 and the number of the return manifold channels M2 are each six.

Each individual channel ICH is a channel through which part of the ink distributed from the supply manifold channel M1 is discharged from a predefined position of a lower surface 100*d* of the ink-jet head 100 and part of the remaining part of the ink returns to the return manifold channel M2. Each individual channel ICH includes a first throttle channel 11, a pressure chamber 12, a descender channel (connection channel) 13, the nozzle 14, and a second throttle channel (discharge channel) 15 from the upstream side toward the downstream side of ink flow.

The first throttle channel 11 is a channel through which the ink in the supply manifold channel M1 is fed to the corresponding pressure chamber 12. The first throttle channels 11 are formed by removing parts of the plates 10B and 10C. An upstream end of the first throttle channel 11 is connected to the supply manifold channel M1 and a downstream end of the first throttle channel 11 is connected to the pressure chamber 12.

The first throttle channel 11 is configured to have a large channel resistance by making a channel cross-sectional area small and making a channel length long. This inhibits a backflow of ink from the pressure chamber 12 to the supply manifold channel M1 when pressure is applied to the pressure chamber 12 (described below). The cross-sectional shape in a plane orthogonal to an extending direction of the first throttle channel 11 is a rectangle or a square.

The pressure chamber 12 is a space for applying pressure by the piezoelectric actuator 20 to ink. The pressure chambers 12 are formed by removing part of the plate 10A disposed at the uppermost side of the channel unit 10. An upper surface of the pressure chamber 12 is formed by a first piezoelectric layer 21 (described below) of the piezoelectric actuator 20.

The shape of the pressure chamber 12 in plan view is a substantially rectangle that is long in the sheet width direction (FIG. 2). The first throttle channel 11 is connected to the vicinity of one of short sides of the pressure chamber 12, and the descender channel 13 is connected to the vicinity of the other of the short sides of the pressure chamber 12. A pressure chamber row $L_{12}$ is formed by twelve pressure chambers 12 arranged in the sheet feeding direction.

The descender channel 13 is a channel through which the ink in the pressure chamber 12 flows into the nozzle 14. The descender channel 13 is formed by coaxially providing circular through holes in the plates 10B to 10G. The descender channel 13 extends downward from the pressure chamber 12 to the nozzle 14.

The nozzle 14 is a minute opening through which ink is discharged to the sheet P. The nozzles 14 are formed in the plate 10H disposed at the lowermost side of the channel unit 10. A nozzle row $L_{14}$ is formed by twelve nozzles 14 arranged in the sheet feeding direction. A lower surface of the plate 10H formed having the nozzles 14 and the nozzle rows $L_{14}$ is the lower surface 100*d* of the ink-jet head 100. The individual channel rows $L_{ICH}$ are arranged to be adjacent to each other in the sheet width direction and to be slightly shifted from each other in the sheet feeding direction. The same is true of the nozzle rows $L_{14}$. The lower surface 100*d* is thus formed having the nozzles 14, which are arranged in the sheet feeding direction substantially without any intervals.

The second throttle channel (discharge channel) 15 is a channel through which part of the ink in the nozzle 14 flows into the return manifold channel M2. An upstream end of the second throttle channel 15 is connected to a circumferential surface of the descender channel 13. A downstream end of the second throttle channel 15 is connected to the return manifold M2.

Figure 4:
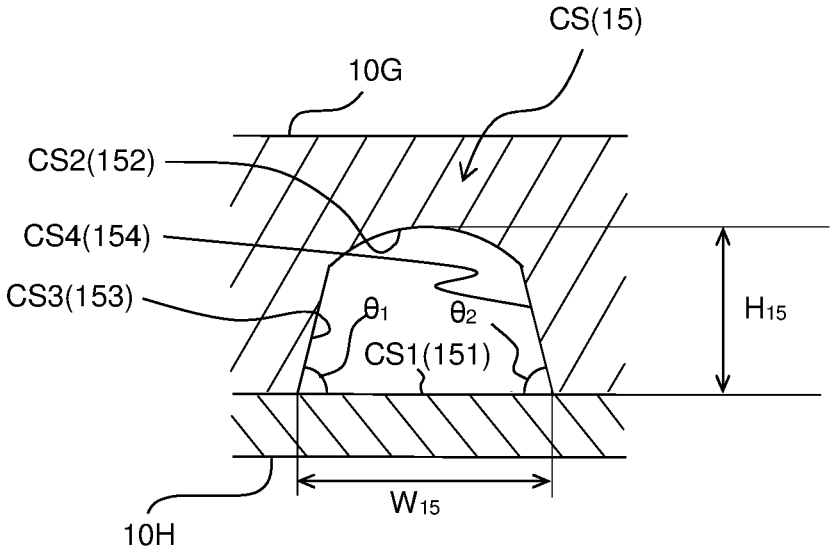
FIG. 4 is a cross-sectional view of a second throttle channel formed in the ink-jet head according to the embodiment of the present disclosure.

The cross-sectional shape of the second throttle channel 15 in a plane (hereinafter referred to as an "orthogonal plane" as appropriate) orthogonal to its extending direction (the sheet width direction in this embodiment) is a trapezoid of which top is replaced by an circular arc that is convex upward (see FIG. 4). Namely, a cross-sectional shape CS of the second throttle channel 15 is formed by a linear bottom portion (third straight line) CS1, an circular arc portion CS2 that is convex upward, a first leg portion (first straight line) CS3 connecting a first end of the bottom portion CS1 and a first end of the circular arc portion CS2, and a second leg portion (second straight line) CS4 connecting a second end of the bottom portion CS1 and a second end of the circular arc portion CS2. The first and second leg portions CS3 and CS4 extend downward from both ends of the circular arc portion CS2 while extending outward in the width direction of the second throttle channel 15. The first and second leg portions CS3 and CS4 are connected to both ends of the bottom portion CS1. More specifically, the first leg portion CS3 extends from the first end of the circular arc portion CS2 to the first end of the bottom portion CS1, and the second leg portion CS4 extends from the second end of the circular arc portion CS2 to the second end of the bottom portion CS1. A distance between the first leg portion CS3 and the second leg portion CS4 in an extending direction of the bottom portion CS1 (a width direction of the second throttle channel 15) increases toward the bottom portion CS1. In other words, the first leg portion CS3 and the second leg portion CS4 extend upward from the both ends of the bottom portion CS1 while being inclined toward each other. The first leg portion CS3 and the second leg portion CS4 are connected to the both ends of the circular arc portion CS2.

The bottom portion CS1 is an intersection line formed by a bottom surface 151 defining the second throttle channel 15 and the orthogonal plane. The circular arc portion CS2 is an intersection line formed by an upper surface 152 defining the second throttle channel 15 and the orthogonal plane. The first leg portion CS3 is an intersection line formed by a first side surface 153 defining the second throttle channel 15 and the orthogonal plane, and the second leg portion CS4 is an intersection line formed by a second side surface 154 defining the second throttle channel 15 and the orthogonal plane. The cross-sectional shape is constant over an entire area of the second throttle channel 15 extending between the descender channel 13 and the return manifold channel M2.

A width $W_{15}$ (a width of the bottom surface 151 and a length of the bottom portion CS1) of the second throttle channel 15 may be equal to a height $H_{15}$ of the second throttle channel 15 (a height from the bottom surface 151 to the top of the upper surface 152, a height from the bottom portion CS1 to the top of the circular arc portion CS2). The width $W_{15}$ may be larger than the height $H_{15}$. The width $W_{15}$ is, for example, approximately 50 to 100 μm. The height $H_{15}$ is, for example, approximately 20 to 70 μm.

On the assumption that a diameter of the descender channel 13 at a connection portion with the second throttle channel 15 is a diameter $D_{13}$, the width $W_{15}$ is smaller than the diameter $D_{13}$. Accordingly, the width $W_{15}$ and the height $H_{15}$ of the second throttle channel 15 are smaller than the diameter $D_{13}$ of the descender channel 13. The cross-sectional area of the second throttle channel 15 is smaller than that of the descender channel 13. Thus, a channel resistance of the second throttle channel 15 is larger than that of the descender channel 13. This inhibits the flowing of an excessive amount of ink from the descender channel 13 to the return manifold channel M2 when pressure is applied to the pressure chamber 12.

An interior angle $\theta_1$ formed by the bottom portion CS1 and the first leg portion CS3 is equal to an interior angle $\theta_2$ formed by the bottom portion CS1 and the second leg portion CS4. Each of the angles $\theta_1$ and $\theta_2$ is approximately 60° to 80°.

The second throttle channel 15 is defined by an upper surface of the plate 10H and a groove that is formed in a lower surface of the plate 10G (by, for example, half etching) and is concave upward. Specifically, the bottom surface 151 of the second throttle channel 15 is formed by the flat upper surface of the plate 10H. The upper surface 152, the first side surface 153, and the second side surface 154 of the second throttle channel 15 are formed by a bottom surface and a side surface of the groove that is formed in the plate 10G and is concave upward. Since a lower end surface of the descender channel 13 is formed by the upper surface of the plate 10H, the lower surface 151 of the second throttle channel 15 is flush with the lower end surface of the descender channel 13.

In the ink-jet head 100 of this embodiment, the second throttle channels 15 having the above configuration allow air bubbles in the descender channels 13 to be efficiently flown into the return manifold channel M2. The reason thereof is described below.

Each supply manifold channel M1 includes a distribution portion M11 by which ink is distributed to the individual channels ICH of the corresponding individual channel row $L_{ICH}$, and a connection portion M12 connecting the distribution portion M11 and the inflow opening P1.

The distribution portion M11 is a channel formed by removing part of the plate 10D and extending linearly in the sheet feeding direction. Respective ends at the sheet supply side and the sheet discharge side in the sheet feeding direction of the distribution portion M11 are positioned at the sheet supply side and the sheet discharge side from the individual channels ICH, which are respectively disposed at an end at the sheet supply side and an end at the sheet discharge side belonging to the corresponding individual channel row $L_{ICH}$. The end at the sheet discharge side in the sheet feeding direction of the distribution portion M11 is closed, and the end at the sheet supply side in the sheet feeding direction of the distribution portion M11 is connected to the connection portion M12.

An upper surface (i.e., a lower surface of the plate 10C) of the distribution portion M11 of the supply manifold channel M1 is connected to the first throttle channels 11 of the individual channels ICH belonging to the corresponding individual channel row $L_{ICH}$. The first throttle channels 11 are arranged in the sheet feeding direction.

The connection portion M12 is formed by removing part of the plate 10D. The connection portion M12 extends rightward in the sheet width direction from the end at the sheet supply side in the sheet feeding direction of the distribution portion M11 while inclined to the sheet feeding direction. The connection portion M12 is connected to the inflow opening P1.

Each inflow opening P1 is formed by coaxially providing the through holes in the plates 10A to 10C. The upper side of the inflow opening P1 is connected to the ink supply channel 701, and the lower side of the inflow opening P1 is connected to the connection portion M12 of the supply manifold channel M1.

Each return manifold channel M2 includes a confluence portion (merging portion) M21 in which ink from the individual channels ICH of the corresponding individual channel row $L_{ICH}$ is merged, and a connection portion M22 connecting the confluence portion M21 and the outflow opening P2.

The confluence portion M21 is formed by removing part of the plate 10G. The confluence portion M21 extends linearly in the sheet feeding direction. Respective ends at the sheet supply side and the sheet discharge side in the sheet feeding direction of the confluence portion M21 are disposed at the sheet supply side and the sheet discharge side from the individual channels ICH, which are respectively disposed at an end at the sheet supply side and an end at the sheet discharge side belonging to the corresponding individual channel row $L_{ICH}$. The end at the sheet discharge side in the sheet feeding direction of the confluence portion M21 is closed, and the end at the sheet supply side in the sheet feeding direction of the confluence portion M21 is connected to the connection portion M22.

A side surface (i.e., a surface formed by removing the part of the plate 10G) defining the confluence portion M21 of the return manifold channel M2 is connected to the second throttle channels 15 of the individual channels ICH belonging to the corresponding individual channel row $L_{ICH}$. The second throttle channels 15 are arranged in the sheet feeding direction.

The connection portion M22 is formed by removing part of the plate 10G. The connection portion M22 extends leftward in the sheet width direction from the end at the sheet supply side in the sheet feeding direction of the confluence portion M21 while inclined to the sheet feeding direction. The connection portion M22 is connected to the outflow opening P2.

The outflow opening P2 is formed by coaxially providing the through holes in the plates 10A to 10F. The upper side of the outflow opening P2 is connected to the ink recovery channel 702, and the lower side of the outflow opening P2 is connected to the connection portion M22 of the return manifold channel M2.

The distribution portion M11 of the supply manifold channel M1 overlaps in the up-down direction with the confluence portion M21 of the return manifold channel M2 (FIGS. 2 and 3). In an area where the distribution portion M11 of the supply manifold channel M1 overlaps in the up-down direction with the confluence portion M21 of the return manifold channel M2, each of a lower surface 10Ed of the plate 10E and an upper surface 10Fu of the plate 10F is removed such that the plates 10E and 10F are thin. In this configuration, a damper chamber DR is defined between the plate 10E and the plate 10F, in other words, between the supply manifold channel M1 and the return manifold channel M2.

The damper chamber DR allows the plate 10E forming a lower surface of the supply manifold channel M1 and the plate 10F forming an upper surface of the return manifold channel M2 to be deformable. The deformation of the plates 10E and 10F inhibits the pressure fluctuation of ink in the supply manifold channel M1 and the return manifold channel M2.

A filter F is provided at connection portions between the inflow openings P1 and the ink supply channel 701 and connection portions between the outflow openings P2 and the ink recovery channel 702. A hole diameter of the filter F may be smaller than the height $H_{15}$ of the second throttle channel 15 so that the second throttle channel 15 may not be clogged with fine foreign matter and the like passing through the filter F. Although FIG. 2 depicts a configuration in which one filter F is provided for all the six inflow openings P1 and the six outflow openings P2, filters may be separately provided for the respective inflow openings P1 and the respective outflow openings P2, or the filter F may be provided for any one of a group of the inflow openings P1 and a group of the outflow openings P2.

<Piezoelectric Actuator 20>

The piezoelectric actuator 20 includes a first piezoelectric layer 21 disposed on an upper surface of the channel unit 10, a second piezoelectric layer 22 disposed above the first piezoelectric layer 21, a common electrode 23 interposed between the first piezoelectric layer 21 and the second piezoelectric layer 22, and a plurality of individual electrodes 24 disposed on an upper surface of the second piezoelectric layer 22.

The first piezoelectric layer 21 is provided on an upper surface of the plate 10A to cover all the individual channels ICH and the pressure chambers 12 formed in the channel unit 10. An upper surface of the first piezoelectric layer 21 is formed having the common electrode 23 that covers a substantially entire area of the upper surface of the first piezoelectric layer 21. An upper surface of the common electrode 23 is formed having the second piezoelectric layer 22 that covers an entire area of the first piezoelectric layer 21 and the common electrode 23.

The first piezoelectric layer 21 and the second piezoelectric layer 22 are made using a piezoelectric material that includes lead zirconate titanate (PZT) as a main component. The lead zirconate titanate is a mixed crystal of lead titanate and lead zirconate. The first piezoelectric layer 21 may be made using any other insulating material than the piezoelectric material, such as a synthetic resin material.

The common electrode 23 is connected to the ground via a trace (not depicted). The common electrode 23 is always kept at a ground potential.

Each individual electrode 24 has a substantially rectangular shape in plan view that is long in the sheet width direction (FIG. 2). The individual electrodes 24 are provided on the upper surface of the second piezoelectric layer 22 (FIG. 2) such that they are positioned above the pressure chambers 12 of the individual channels ICH. Each individual electrode 24 is positioned above a center portion of the corresponding pressure chamber 12.

In a structure in which the first piezoelectric layer 21, the second piezoelectric layer 22, the common electrode 23, and the individual electrodes 24 are disposed as described above, portions of the second piezoelectric layer 22 interposed between the common electrode 23 and the respective individual electrodes 24 are active portions 22*a* polarized in a thickness direction.

A connection terminal 24*a* is defined at an end in the sheet width direction (end positioned at an opposite side of the descender channel 13 of the pressure chamber 12 in plan view) of each individual electrode 24. Each individual electrode 24 is connected to a driver IC (not depicted) via the connection terminal 24*a* and a trace (not depicted). The driver IC applies any of the ground potential and a predefined drive potential (e.g., approximately 20V) to each individual electrode 24.

In order to apply pressure to the ink in a certain pressure chamber 12 (referred to as a target pressure chamber) included in the pressure chambers 12 by use of the actuator 20, the driver IC applies the drive potential to the individual electrode 24 that corresponds to the target pressure chamber. This generates an electric field parallel to a polarization direction in the active portion 22*a* that is interposed between the individual electrode 24 to which the drive potential is applied and the common electrode 23. The active portion 22*a* thus contracts in a horizontal direction orthogonal to the polarization direction.

The contraction of the active portion 22*a* deforms (bends) a stacked body that is positioned above the target pressure chamber and formed by the first piezoelectric layer 21, the common electrode 23, the second piezoelectric layer 22, and the individual electrode 24 so that an entire portion of the stacked body becomes convex toward the target pressure chamber. The volume of the target pressure chamber is thus reduced, and the pressure of ink in the target pressure chamber is increased. As a result, ink droplets are discharged from the nozzle 14 communicating with the pressure chamber 12 via the descender channel 13. The contraction of the active portion 22*a* is eliminated by switching the electric potential, applied by the driver IC to the individual electrode 24 corresponding to the target pressure chamber, to the ground potential, and the application of pressure to the ink in the target pressure chamber is eliminated.

<Image Formation Method>

Image formation on the sheet P by use of the printer 1000 and the ink-jet head 100 is performed as follows.

The sheet P on a feed tray (not depicted) is fed to the sheet supply side of the conveyance roller 401, and is supplied onto the platen 300 by the conveyance roller 401. The ink-jet heads 100 discharge ink droplets on the sheet P during the feeding of the sheet P by use of the conveyance rollers 401 and 402, thus forming an image on the sheet P. The sheet P for which the image is formed is fed toward the sheet discharge side of the conveyance roller 402, and discharged on a discharge tray (not depicted).

The discharge of the ink droplet from each ink-jet head 100 is performed by causing the actuator 20 to apply pressure to the ink in the pressure chamber 12 of a desired individual channel ICH included in the individual channels ICH. The ink droplet is thus discharged from the nozzle 14 of the desired individual channel ICH on the sheet P. Flowing of ink from the subtank 600 to the desired individual channel ICH via the ink supply channel 701, the inflow opening P1, and the supply manifold channel M1 is generated simultaneously with the ink discharge, and ink is supplied to the pressure chamber 12 and the descender channel 13.

In the printer 1000, also during a period in which no ink is discharged from each ink-jet head 100, the pump 800 maintains ink circulation at a low velocity along a circulation channel CC ranging from the subtank 600 to the subtank 600 via the ink supply channel 701, the supply manifold channel M1, the individual channels ICH, the return manifold channel M2, and the ink recovery channel 702. This inhibits the change in characteristics (e.g., the increase in concentration due to drying) of ink which has been staying in the individual channels ICH for a long period.

<Discharge of Air Bubbles via Second Throttle Channel 15>

Subsequently, the discharge of air bubbles via the second throttle channel 15 according to this embodiment is explained.

When image formation is performed by using the printer 1000 and the ink-jet heads 100 according to this embodiment, air bubbles may intrude into the descender channels 13 via the nozzles 14. When pressure is applied to the ink in the pressure chambers 12 in a state where air bubbles are in the descender channels 13, the applied pressure may be used for compressing air bubbles, and ink may not be discharged properly from the nozzles 14.

In the printer 1000 and each ink-jet head 100 of this embodiment, ink always circulates along the circulation channel CC. This allows the air bubbles intruded into the descender channels 13 to flow to the return manifold M2 via the second throttle channels 15.

Figure 5A:
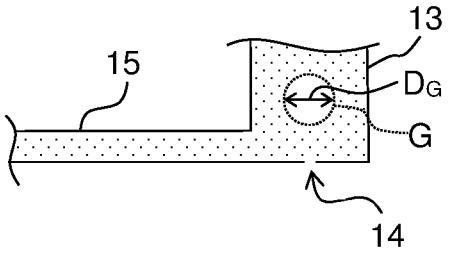
Figure 5B:
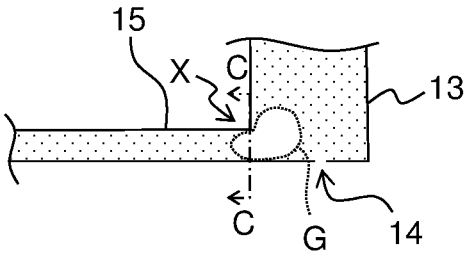

Here, as depicted in FIG. 5A, an air bubble G having a diameter $D_G$ larger than the height $H_{15}$ of the second throttle channel 15 may intrude into the descender channel 13 through the nozzle 14. In this situation, ink circulation causes the air bubble G to flow toward the second throttle channel 15. However, at a connection portion X between the descender channel 13 and the second throttle channel 15 where the cross-section of the channel decreases, only part of the air bubble G enters the second throttle channel 15 and remaining part of the air bubble G remains in the descender channel 13, namely the air bubble G is caught in the entrance of the second throttle channel 15 (FIG. 5B).

Air bubbles are typically spherical or substantially spherical. Although the cross-sectional shape of the air bubble when the air bubble is pushed into a pipe having a predefined cross-sectional shape (the cross-sectional shape in a plane orthogonal to an extending direction of the pipe) varies depending on the cross-sectional shape of the pipe, an upper side of the cross-sectional shape of the air bubble (upper side in a gravity direction) is circular arc or arc that is convex upward.

Figure 5C:
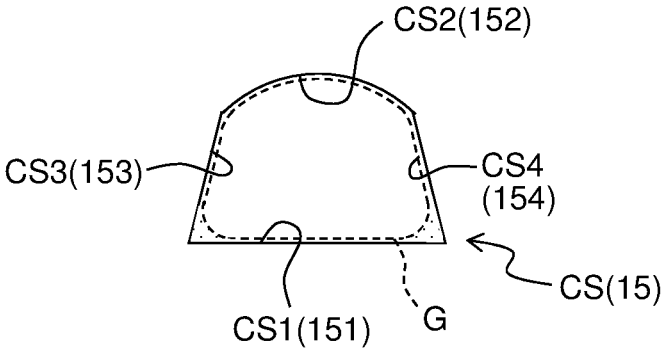

Thus, the upper-side cross-sectional shape of the air bubble G that is slightly pushed into the second throttle channel 15 from the connection portion X, at the connection portion X, is a shape substantially along the circular arc portion CS2 and the first and second leg portions CS3 and CS4 (FIG. 5C).

The lower-side cross-sectional shape of the air bubble G that is slightly pushed into the second throttle channel 15 from the connection portion X, at the connection portion X, is a shape substantially along the first and second leg portions CS3 and CS4 (FIG. 5C). This is because the air bubble G is pushed by the bottom surface 151 and the upper surface 152 of the second throttle channel 15 as well as the first and second side surfaces 153 and 154 that extend downward and diverge (spread) widthwise from both ends of the upper surface 152 to both ends of the bottom surface 151 so as to expand toward a connection portion between the bottom surface 151 and the first side surface 153 and a connection portion between the bottom surface 151 and the second side surface 154. More specifically, since the first side surface 153 is not perpendicular to the bottom surface 151, but inclined to the bottom surface 151, such that one segment of the side surface 153 is positioned inward of another segment of the side surface 153 just below the one segment in width direction of the second throttle channel 15, the air bubble G is sandwiched by the first side surface 153 and the bottom surface 151 in a circumferential direction of which center is the connection portion between the first side surface 153 (first leg portion CS3) and the bottom surface 151 (bottom portion CS1), and the air bubble G tends to expand toward the upper surface 152 and the second side surface 154. However, the air bubble G can not expand toward the upper surface 152 and the second side surface 154 by being restricted by the upper surface 152 and the second side surface 154. The air bubble G thus expands toward the connection portion between the first side surface 153 and the bottom surface 151. The air bubble G expands toward the connection portion between the second side surface 154 and the bottom surface 151 for a similar reason.

Thus, in a state where only part of the air bubble G enters the second throttle channel 15 and remaining part of the air bubble G remains in the descender channel 13, a large part of the periphery of the cross-sectional shape of the air bubble G extends along the cross-section CS of the second throttle channel 15. A gap between the air bubble G and the second throttle channel 15 is very small In other words, the second throttle channel 15 is closed by the air bubble G completely or substantially completely. Thus, ink circulation generates a great pressure difference between the descender channel 13 and the second throttle channel 15, and the bubble G is pushed into the second throttle channel 15 by the pressure difference.

Figure 5D:
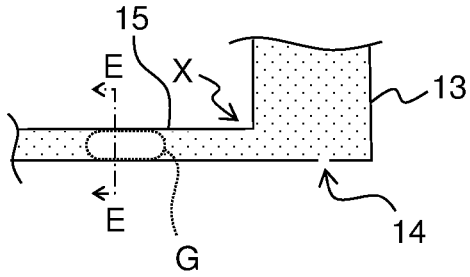
Figure 5E:
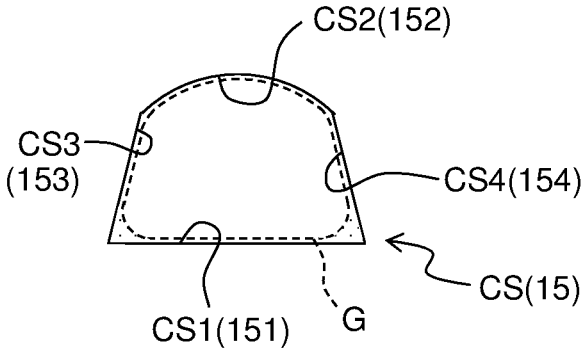

The cross-sectional shape of the air bubble G does not change after the air bubble G is pushed into the second throttle channel 15. In the entire portion of the second throttle channel 15, the cross-sectional shape of the air bubble G is maintained at the shape along the cross-sectional shape of the second throttle channel 15 (FIGS. 5D and 5E). The air bubble G thus receives almost all the pressing force caused by the ink circulation in the second throttle channel 15, and the air bubble G is efficiently washed away to the return manifold channel M2.

Figure 5F:
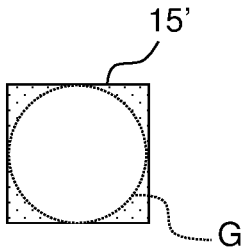

In a comparative example in which the second throttle channel 15 is replaced by a second throttle channel 15' of which cross-sectional shape in a plane orthogonal to its extending direction is a square, the cross-sectional shape of the air bubble G in the plane orthogonal to the extending direction of the second throttle channel 15' is a substantially circular in a state where only part of the air bubble G in the descender channel 13 is pushed into the second throttle channel 15', as well as in a state where the entirety of the air bubble G is pushed into the second throttle channel 15'. A gap is thus generated at each corner of the second throttle channel 15' of which cross-sectional shape is a square (FIG. 5F). The size of the gap is 20% or more of the cross-sectional area of the second throttle channel 15' in the comparative example.

Accordingly, in the comparative example using the second throttle channel 15', neither the connection portion X with the descender channel 13 nor other areas of the second throttle channel 15' are completely clogged with the air bubble G. Ink thus flows through a large gap between a circumference surface of the second throttle channel 15' and the air bubble G, making it impossible to push the air bubble G efficiently. As a result, the air bubble G is likely to stay at the connection portion between the second throttle channel 15' and the descender channel 13. Even if the air bubble G enters the second throttle channel 15', the air bubble G is liable to stay in the second throttle channel 15'.

Main effects of the ink-jet heads 100 and the printer 1000 according to this embodiment are described below.

In the ink-jet head 100 of this embodiment, the cross-sectional shape CS, of the second throttle channel 15 through which the air bubble intruding into the descender channel 13 flows into the return manifold channel M2, includes the circular arc portion CS2 being convex upward. Thus, the shape of the air bubble follows the shape of the circular arc portion CS2 of the cross-sectional shape CS (i.e., the shape of the upper surface 152 of the second throttle channel 15) to make the gap between the upper surface 152 and the air bubble small. This allows the air bubble that may cause the deterioration in image quality to be efficiently washed away to the return manifold channel M2, and the air bubble can be discharged from the ink-jet head 100 satisfactorily.

In the ink-jet head 100 according to this embodiment, the cross-sectional shape CS of the second throttle channel 15 through which the air bubble intruded into the descender channel 13 flows into the return manifold channel M2 further includes the bottom portion CS1, the first leg portion CS3, and the second leg portion CS4. The cross-sectional shape CS of the second throttle channel 15 thus has substantially the trapezoid. This makes the aspect ratio of the cross-sectional shape CS small. Thus, (when the pumps 800 have the same pressure), it is possible to make the channel resistance of the second throttle channel 15 small and to make the flow rate in the second throttle channel 15 high. The air bubble that may cause the deterioration in image quality can thus be washed way to the return manifold channel M2 efficiently.

Since the printer 1000 of this embodiment includes the ink-jet heads 100, the printer 1000 can have the same effects as the ink-jet heads 100.

MODIFIED EXAMPLES

The following modified embodiments can be used in the above embodiment.

In the ink-jet head 100 of the above embodiment, the cross-sectional shape CS of the second throttle channel 15 (i.e., the shape of the circumference surfaces defining the second throttle channel 15) may be changed in various ways.

Figure 6A:
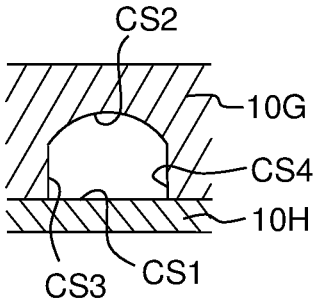
FIGS. 6A to 6H are cross-sectional views each depicting a modified example of a cross-sectional shape of the second throttle channel.

As an example, as depicted in FIG. 6A, the first leg portion CS3 and the second leg portion CS4 may be perpendicular to the bottom portion CS1. This shape can be easily produced compared to the cross-sectional shape CS of the above embodiment. In the cross-sectional shape CS of the above embodiment, the angle $\theta_1$ is equal to the angle $\theta_2$. The angle $\theta_1$, however, may be different from the angle $\theta_2$.

Figure 6B:
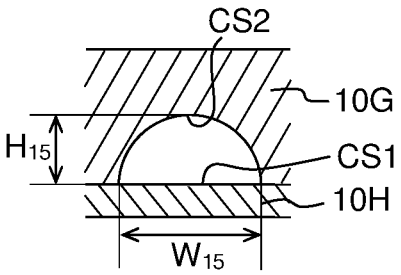

As depicted in FIG. 6B, the cross-sectional shape CS of the second throttle channel 15 may be a semicircular shape formed only by the bottom portion CS1 and the circular arc portion CS2. In this modified example, the width $W_{15}$ is twice the height $H_{15}$, and the aspect ratio is 2:1. Accordingly, the channel resistance of the second throttle channel 15 is further increased by making the aspect ratio of the cross-sectional shape higher, and the flowing of an excessive amount of ink is inhibited more successfully at the time of the ink discharge.

Figure 6C:
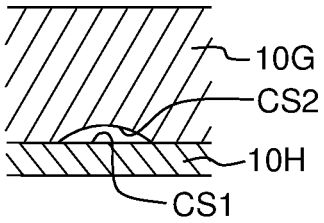
Figure 6D:
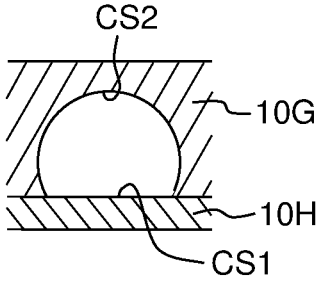

In the cross-sectional shape CS depicted in FIG. 6B, the radius of curvature of the circular arc portion CS2 is half of the length of the bottom portion CS1. However, it is merely a non-limitative example. When the radius of curvature of the circular arc portion CS2 is larger with the length of the bottom portion CS1 being kept constant, the gap between the top of the circular arc portion CS2 and the bottom portion CS1 is smaller and the cross-sectional area is also smaller (FIG. 6C). On the other hand, when the radius of curvature of the circular arc portion CS2 is smaller with the length of the bottom portion CS1 being kept constant, the gap between the top of the circular arc portion CS2 and the bottom portion CS1 is larger and the cross-sectional area is also larger (FIG. 6D).

In the cross-sectional shape CS of each of the above embodiment and the modified examples, the circular arc portion CS2 may be replaced by an arc-like portion (arc portion) not having a certain curvature radius. The arc portion is not part of a circle. In the specification and the claims of this patent application, a shape formed by the arc portion or the circular arc portion and a straight line portion connecting both ends thereof is collectively referred to as an "arcuate shape".

Figure 6E:
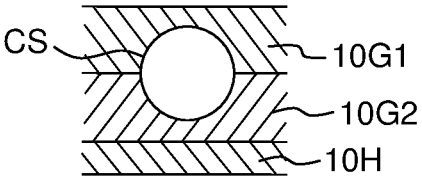
Figure 6F:
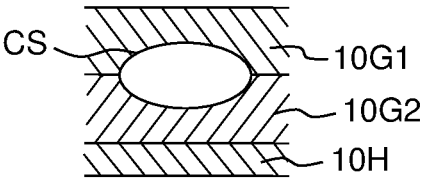
Figure 6G:
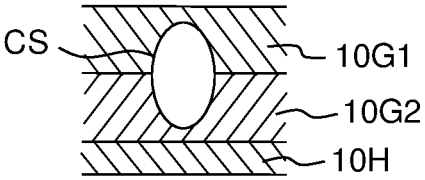

The cross-sectional shape CS of the second throttle channel 15 may be a circular shape (FIG. 6E) or an elliptical shape (FIGS. 6F and 6G). In this case, two plates 10G1 and 10G2 may be used instead of the plate 10G. The second throttle channel 15 having the circular or elliptical cross-sectional shape CS may be defined by a groove that is formed in a lower surface of the plate 10G1 and is concave upward and a groove that is formed in an upper surface of the plate 10G2 and is concave downward. As described above, the air bubbles are typically spherical. Thus, when the cross-sectional shape CS of the second throttle channel 15 is a circular shape, the gap between the circumferential wall of the second throttle channel 15 and the air bubbles can be further narrowed.

The cross-sectional shape CS of the second throttle channel 15 may be an elliptical shape of which short axis (minor axis) direction extends along the up-down direction. This makes the gap between the circumferential wall of the second throttle channel 15 and the air bubble small. Since buoyancy pushes the air bubble from below and the air bubble expands in a horizontal direction, the air bubble is likely to follow the elliptical shape that is long in the horizontal direction.

In the cross-sectional shape CS of each of the above embodiment and the modified examples, a ratio of the width to the height (i.e., aspect ratio) may be changed as needed. Making the aspect ratio large can further increase the channel resistance of the second throttle channel 15. Making the aspect ratio close to 1 easily results in a shape that is successfully followed by the air bubble typically having a spherical shape.

The cross-sectional shape CS of the second throttle channel 15 may be any shape in which a portion corresponding to an intersection line formed by the upper surface 152 of the second throttle channel 15 and a plane orthogonal to the extending direction of the second throttle channel 15 is convex upward to have an arc shape. This makes the gap between the upper portion of the air bubble and the upper surface 152 of the second throttle channel 15 small, thus allowing ink to efficiently push the air bubble toward the downstream side of the second throttle channel 15. The top of the shape that is convex upward to have an arc shape is not necessarily positioned at a center portion in the width direction of the channel. In the specification and the claims of this patent application, the "upper surface of the channel" and the "upper surface defining the channel" mean a surface defining the channel at the upper side in the gravity direction with respect to the liquid flowing through the channel (or a surface defining the channel in a direction in which the air bubbles in the liquid move by receiving the buoyance caused by hydrostatic pressure with respect to the liquid flowing through the channel).

In the above embodiment, the cross-sectional shape CS of the second throttle channel 15 is constant over the entire area in the extending direction of the second throttle channel 15. However, it is merely a non-limitative example. For example, the second throttle channel 15 may have the cross-sectional shape CS of the above embodiment only in the connection portion X with the descender channel 13 or an area in the vicinity of the connection portion X. Also in this configuration, the air bubbles can be efficiently pushed into the second throttle channel 15 from the descender channel 13. In this configuration, the cross-sectional shape of any other area of the second throttle channel 15 may be a rectangle or a square.

In the above embodiment, the second throttle channel 15 is defined by the upper surface of the plate 10H and the groove that is formed in the lower surface of the plate 10G through half etching and is concave upward. However, it is merely a non-limitative example. Specifically, for example, two plates may be used instead of the plate 10G. In this case, the groove forming the upper surface 152 of the second throttle channel 15 (circular arc portion CS2 of the cross-sectional shape CS) is formed in a lower surface of the first plate through half etching, and a slit forming the first and second side surfaces 153 and 154 of the second throttle channel 15 (the first and second leg portions CS3 and CS4 of the cross-sectional shape CS) is formed in the second plate through full etching. The two plates are placed on a flat upper surface of the third plate. Accordingly, a stacked structure in which the first plate, the second plate, and the third plate are stacked on top of each other in that order from the top is obtained.

Figure 6H:
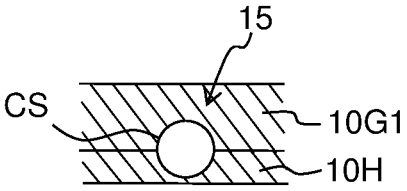

As described above, it may be possible to arbitrarily select how many plates are used for forming the second throttle channel 15 (cross-sectional shape CS) according to each of the embodiment and the modified examples. Reducing the number of plates used for forming the second throttle channel 15 may downsize the ink-jet head 100. In the above embodiment, the ink-jet head 100 is downsized by integrally forming the lower surface 151 of the second throttle channel 15 and the nozzle 14 from the plate 10H. Similarly, the ink-jet head 100 may be downsized by forming the lower side of the second throttle channel 15 according to the modified example from the plate 10H used for forming the nozzle 14 (FIG. 6H).

In the second throttle channel 15 according to each of the above embodiment and the modified examples, the surface roughness of the upper surface 152 may be increased. This makes it possible to further increase the channel resistance of the second throttle channel 15. Making the upper surface 152 of the second throttle channel 15 rough can be performed by adjusting conditions for half etching when the groove defining the upper surface 152 and the first and second side surfaces 153 and 154 of the second throttle channel 15 is formed in the plate 10G. The surface roughness of the roughened upper surface 152 is larger than the surface roughness of a surface not subjected to half etching, such as the lower surface 151 of the second throttle channel 15 and the lower end surface of the descender channel 13. The surface roughness is, for example, approximately 0.5 to 1.5 μm (arithmetic mean roughness Ra).

Figure 7:
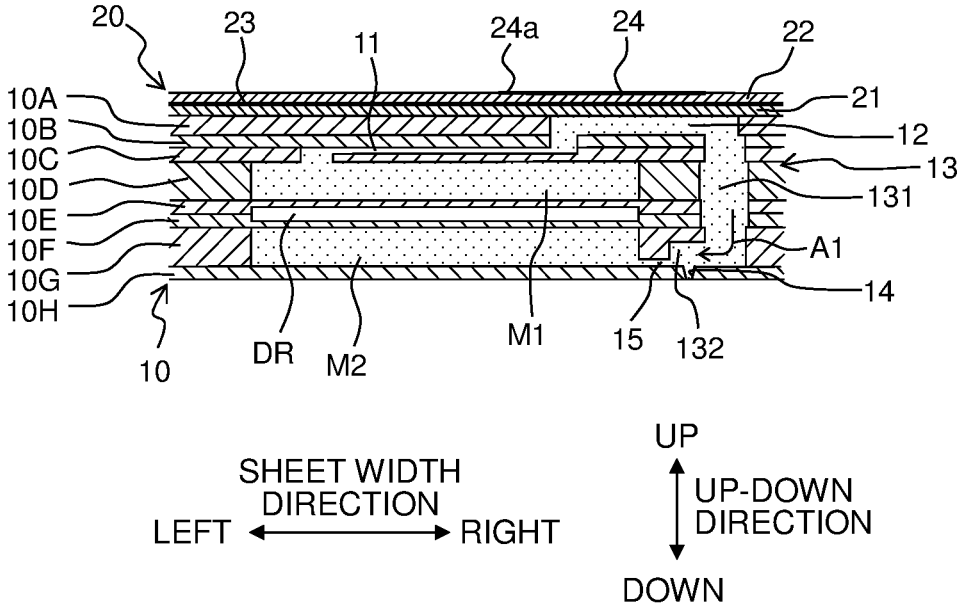
FIG. 7 is a schematic cross-sectional view of an ink-jet head according to a modified example.

In the ink-jet head 100 according to each of the embodiment and the modified examples, the descender channel 13 of the channel unit 10 may have a first portion 131 extending in the up-down direction and a second portion 132 extending in the sheet width direction from the first portion 131 (FIG. 7). In this case, the nozzle 14 is provided at the bottom surface of the second portion 132. The second throttle channel 15 is connected to a side surface orthogonal to the sheet width direction of the second portion 132.

In the modified example, as indicated by an arrow A1 in FIG. 7, in the second portion 132, a direction in which ink flows along the circulation channel CC is substantially parallel to the sheet width direction. This ink flow thus allows the air bubbles in the second portion 132 to be more efficiently washed away from the side surface orthogonal to the sheet width direction to the second throttle channel 15 extending in the sheet width direction.

Figure 8:
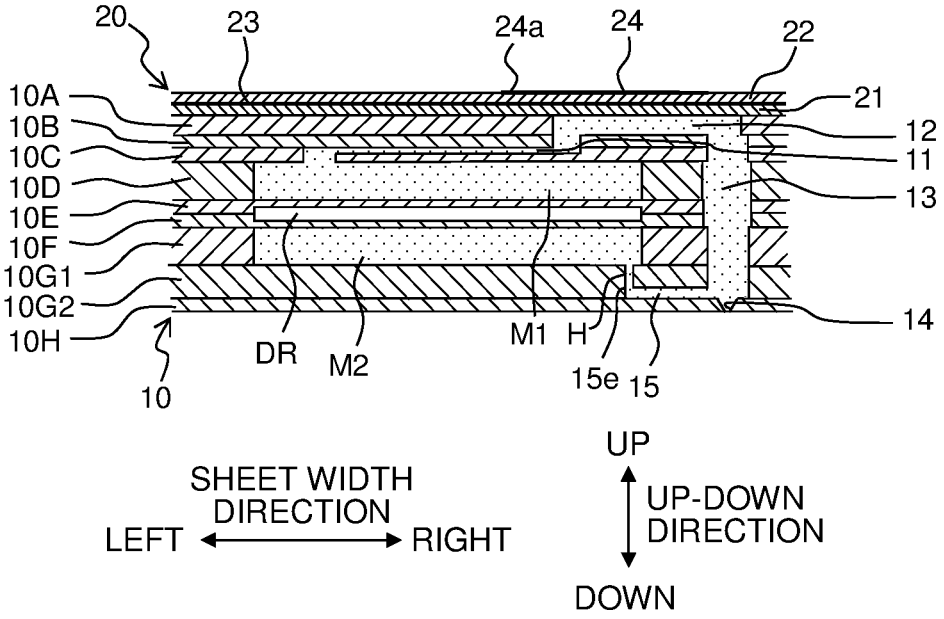
FIG. 8 is a schematic cross-sectional view of an ink-jet head according to another modified example.

In the ink-jet head 100 according to each of the embodiment and the modified examples, the downstream end of the second throttle channel 15 is connected to the side surface of the return manifold channel M2. However, it is merely a non-limitative example. For example, as depicted in FIG. 8, a downstream end 15*e* of the second throttle channel 15 may be formed having a communicating hole H that extends upward from the top of the upper surface 152 of the second throttle channel 15 (position corresponding to the top of the circular arc portion CS2 in the cross-sectional shape CS) and opened in the lower surface of the return manifold channel M2. Since the air bubbles gather at the top of the upper surface 152 due to buoyance, the air bubbles in the second throttle channel 15 can be washed away to the return manifold channel M2 more efficiently by providing the communicating hole H that communicates with the return manifold channel M2 at the top of the upper surface 152.

In the ink-jet head 100 according to each of the embodiment and the modified examples, the pump 800 allows ink to circulate along the circulation channel CC ranging from the subtank 600 to the subtank 600 via the ink supply channel 701, the supply manifold channel M1, the individual channels ICH, the return manifold channel M2, and the ink recovery channel 702. However, it is merely a non-limitative example. The pump 800 may circulate ink along a circulation channel RCC ranging from the subtank 600 to the subtank 600 via the ink recovery channel 702, the return manifold channel M2, the individual channels ICH, the supply manifold channel M1, and the ink supply channel 701. Ink flows through the circulation channel RCC in a direction opposite to that of the circulation channel CC.

In this case, ink flows through the individual channel ICH in the order of the second throttle channel 15, the descender channel 13, the pressure chamber 12, and the first throttle channel 11. The air bubbles intruded into the descender channel 13 via the nozzle 14 are discharged from the first throttle channel 11 to the supply manifold channel M1 via the pressure chamber 12. Thus, in this modified embodiment, the first throttle channel 11 corresponds to the "discharge channel" of the present invention, and the first throttle channel 11 has the cross-sectional shape CS that corresponds to the cross-sectional shape CS of the second throttle channel 15 in the ink-jet head 100 according to each of the embodiment and the modified examples.

The embodiment and the modified examples are explained above by using examples in which image formation is performed on the sheet P by discharging ink from the ink-jet heads 100. However, it is merely a non-limitative example. The ink-jet head 100 may be a liquid discharge apparatus that discharges any liquid for image formation. A medium on which image formation is performed may be any other medium than the sheet P, such as fiber or resin. The ink-jet heads 100 may be used in a printer of a serial head type.

The present invention is not limited to the embodiment and the modified examples, provided that characteristics of the present invention can be obtained. The present invention includes any other embodiments which can be conceived in the range of technical ideas of the present invention.

The liquid discharge apparatus and the image recording apparatus of the present disclosure are capable of inhibiting the deterioration in image quality due to the intrusion of air bubbles, and forming an image having a high quality.

The liquid discharge apparatus and the image recording apparatus of the present disclosure can satisfactorily discharge air bubbles mixed into a liquid in the liquid discharge apparatus.

What is claimed is:

1. A liquid discharge apparatus configured to discharge a liquid, comprising a channel member for the liquid, wherein the channel member is formed to include:

a pressure chamber configured to contain the liquid;

a nozzle configured to discharge the liquid;

a connection channel connecting the pressure chamber and the nozzle; and a discharge channel which is connected to the connection channel so as to discharge the liquid in the connection channel or connected to the pressure chamber so as to discharge the liquid in the pressure chamber, and an intersection line between an orthogonal plane orthogonal to an extending direction of the discharge channel and an upper surface of the discharge channel defining an upper portion of the discharge channel has an arc-like shape protruding upwardly.

2. The liquid discharge apparatus according to claim 1, wherein the discharge channel is connected to the connection channel so as to discharge the liquid in the connection channel.

3. The liquid discharge apparatus according to claim 1, wherein:

an intersection line between the orthogonal plane and a first side surface defining the discharge channel is a first straight line, an intersection line between the orthogonal plane and a second side surface facing the first side surface and defining the discharge channel is a second straight line, and an intersection line between the orthogonal plane and a bottom surface facing the upper surface and defining the discharge channel is a third straight line; and the first straight line and the second straight line extend upward from both ends of the third straight line while being inclined toward each other.

4. The liquid discharge apparatus according to claim 1, wherein an intersection line between the orthogonal plane and a bottom surface of the discharge channel defining a lower portion of the discharge channel is a straight line connecting a first end and a second end of the intersection line between the orthogonal plane and the upper surface of the discharge channel having the arc-like shape protruding upwardly.

5. The liquid discharge apparatus according to claim 1, wherein a shape of an intersection line between the orthogonal plane and a circumferential surface defining the discharge channel is a circle.

6. The liquid discharge apparatus according to claim 5, wherein the channel member has a stacked structure including a first plate and a second plate placed on the first plate, and the discharge channel is defined by a concave groove in an upper surface of the first plate and a concave groove in a lower surface of the second plate.

7. The liquid discharge apparatus according to claim 6, wherein the nozzle extends through the first plate.

8. The liquid discharge apparatus according to claim 1, wherein a shape of an intersection line between the orthogonal plane and a circumferential surface defining the discharge channel is an ellipse.

9. The liquid discharge apparatus according to claim 8, wherein a minor axis direction of the ellipse extends in an up-down direction.

10. The liquid discharge apparatus according to claim 1, wherein a width of the discharge channel is larger than a height of the discharge channel.

11. The liquid discharge apparatus according to claim 10, wherein a width of the connection channel in a width direction of the discharge channel is larger than the width of the discharge channel.

12. The liquid discharge apparatus according to claim 1, wherein a width of the discharge channel is equal to a height of the discharge channel.

13. The liquid discharge apparatus according to claim 1, wherein a surface roughness of the upper surface of the discharge channel is larger than a surface roughness of an inner surface of the connection channel.

14. The liquid discharge apparatus according to claim 1, wherein the connection channel includes a first portion extending in an up-down direction and a second portion extending from a lower end of the first portion along the extending direction of the discharge channel, and the nozzle and the discharge channel are connected to the second portion.

15. The liquid discharge apparatus according to claim 1, wherein the pressure chamber in the channel member includes a plurality of pressure chambers, the connection channel in the pressure chamber includes a plurality of connection channels, the discharge channel in the channel member includes a plurality of discharge channels, and the nozzle in the pressure chamber includes a plurality of nozzles, a manifold connected to the plurality of discharge channels and through which the liquid from the plurality of discharge channels flows outside the channel member is formed in the channel member, and at least one of the plurality of discharge channels is connected to the manifold via a top portion of the upper surface having the arc-like shape protruding upwardly.

16. The liquid discharge apparatus according to claim 1, wherein a supply opening through which the liquid is supplied to the channel member and a discharge opening through which the liquid in the channel member is discharged is formed in the channel member, the supply opening or the discharge opening is provided with a filter, and a height of the discharge channel is greater than a hole diameter of the filter.

17. The liquid discharge apparatus according to claim 1, wherein the upper surface is an upper surface at an upstream end of the discharge channel in a direction in which the liquid is discharged from the discharge channel.

18. An image recording apparatus, comprising:

the liquid discharge apparatus as defined in claim 1, a liquid supply channel through which the liquid is supplied to the liquid discharge apparatus, a liquid recovery channel through which the liquid is recovered from the liquid discharge apparatus, and a pump configured to apply pressure so that the liquid flows through the liquid supply channel, the pressure chamber, the connection channel, the discharge channel, and the liquid recovery channel in that order.

* * * * *